US008876429B2

(12) United States Patent
Fay, Sr.

(10) Patent No.: US 8,876,429 B2
(45) Date of Patent: Nov. 4, 2014

(54) LOCKING DEVICES FOR BOAT LIFTS

(76) Inventor: Shawn M. Fay, Sr., Glenshaw, PA (US)

( * ) Notice: Subject to any disclaimer, the term of this patent is extended or adjusted under 35 U.S.C. 154(b) by 0 days.

(21) Appl. No.: 13/571,672

(22) Filed: Aug. 10, 2012

(65) Prior Publication Data

US 2014/0044484 A1 Feb. 13, 2014

(51) Int. Cl.
*B63C 1/00* (2006.01)

(52) U.S. Cl.
USPC ..... 405/3

(58) Field of Classification Search
USPC ..... 405/3; 254/323; 212/292; 70/14, 94, 70/209; 292/56, 67, 289; 114/44–48
See application file for complete search history.

(56) References Cited

U.S. PATENT DOCUMENTS 5,018,690 A * 5/1991 Widmer ..... 246/428
5,363,679 A * 11/1994 Prasad ..... 70/209
6,058,749 A * 5/2000 Rekemeyer ..... 70/226
6,553,797 B2 * 4/2003 Witchey ..... 70/209
6,619,708 B1 * 9/2003 Naylor ..... 292/259 R
7,299,758 B1 * 11/2007 Bogart ..... 114/44
7,547,159 B1 * 6/2009 Warters ..... 405/3
7,765,945 B2 * 8/2010 Radcliff ..... 114/44
7,856,936 B2 * 12/2010 Nemethy ..... 114/44
2010/0239371 A1 * 9/2010 Brown ..... 405/3

OTHER PUBLICATIONS

SwingStoppers LLC, "LiftGuardian", Nov. 22, 2011 capture from WayBack Machine, retrieved on Jan. 30, 2013 from www.swingstoppers.com/LiftGuardian.php.*

SwingStoppers LLC, "LiftGuardian Video", 1:03 minute video captured on the WayBack Macine on Nov. 22, 2011, retrieved on Jan. 30, 2013 from www.swingstoppers.com/LiftGuardian.php.*

YouTube, "LiftGuardian Video", 1:03 minute video uploaded to YouTube by SwingStoppers on Jan. 10, 2011, http://www.youtube.com/watch?v=SzGgiWLfQ1w&feature=player_embedded.*

* cited by examiner

*Primary Examiner* — Thomas B Will
*Assistant Examiner* — Jessica H Lutz
(74) *Attorney, Agent, or Firm* — K&L Gates LLC

(57) ABSTRACT

Various security members for selectively preventing movement of a boat-supporting cradle of a boat lift system. In one form, each security member is structured to hang from a longitudinal support on the boat lift system and to operably move along the longitudinal support between an engaged position and a disengaged position. Each security member comprises a bracket structured to hold the cradle in a secured position when the security member is in the engaged position.

13 Claims, 8 Drawing Sheets

LOCKING DEVICES FOR BOAT LIFTS

BACKGROUND

A boat lift system may be used to dock and store a wide variety of boats such as power boats, pontoon boats, sailboats, and personal watercrafts, for example. A boat lift system may include a cradle and a lift mechanism that affects movement of the cradle. The cradle may move upward and downward to lift and lower a boat held by the cradle relative to the surface of the water. Further, the lift mechanism may be controlled by a control system. The control system of the lift mechanism may be secure to prevent unauthorized use of the lift mechanism and subsequent unauthorized use of the boat held by the cradle. For example, the control system may be secure by requiring a key or access code for operation or by otherwise positioning the control system in a secure location such as a boathouse or garage, for example.

Some lift mechanisms for a boat lift system may include a cable that attaches to the cradle. Though the control system of the lift mechanism may be secure, an unauthorized user could sever the cable to drop the cradle and release the boat from the boat lift system. Additionally, environmental conditions may cause corrosion of the cable, which may similarly cause the cable to break and release the boat. When the boat is dropped into the water and released, the boat may sustain damages. Furthermore, the cable of the lift mechanism may be substantially flexible such that severe weather conditions, including strong winds, thunderstorms, and hurricanes, for example, may cause shifting of the cable and a corresponding shifting of the cradle and the boat held by the cradle. As the boat shifts, it may strike part of the boat lift system or another object or structure, which may cause damage to the boat.

Accordingly, it may be advantageous to provide a security member the restrains shifting of the cradle and/or the boat held therein during severe weather. Furthermore, it may be advantageous to provide a security member that holds the boat in the boat lift system despite severance of the lift mechanism cables. Additionally, it may be advantageous to provide a security member that prevents theft and/or unauthorized and/or unintentional release of a boat from a boat lift system. More generally, it may be advantageous to provide an improved security member for a boat lift system.

BRIEF DESCRIPTION OF THE FIGURES

The features and advantages of the present invention may be better understood by reference to the accompanying Figures in which.

DETAILED DESCRIPTION

Figure 1:
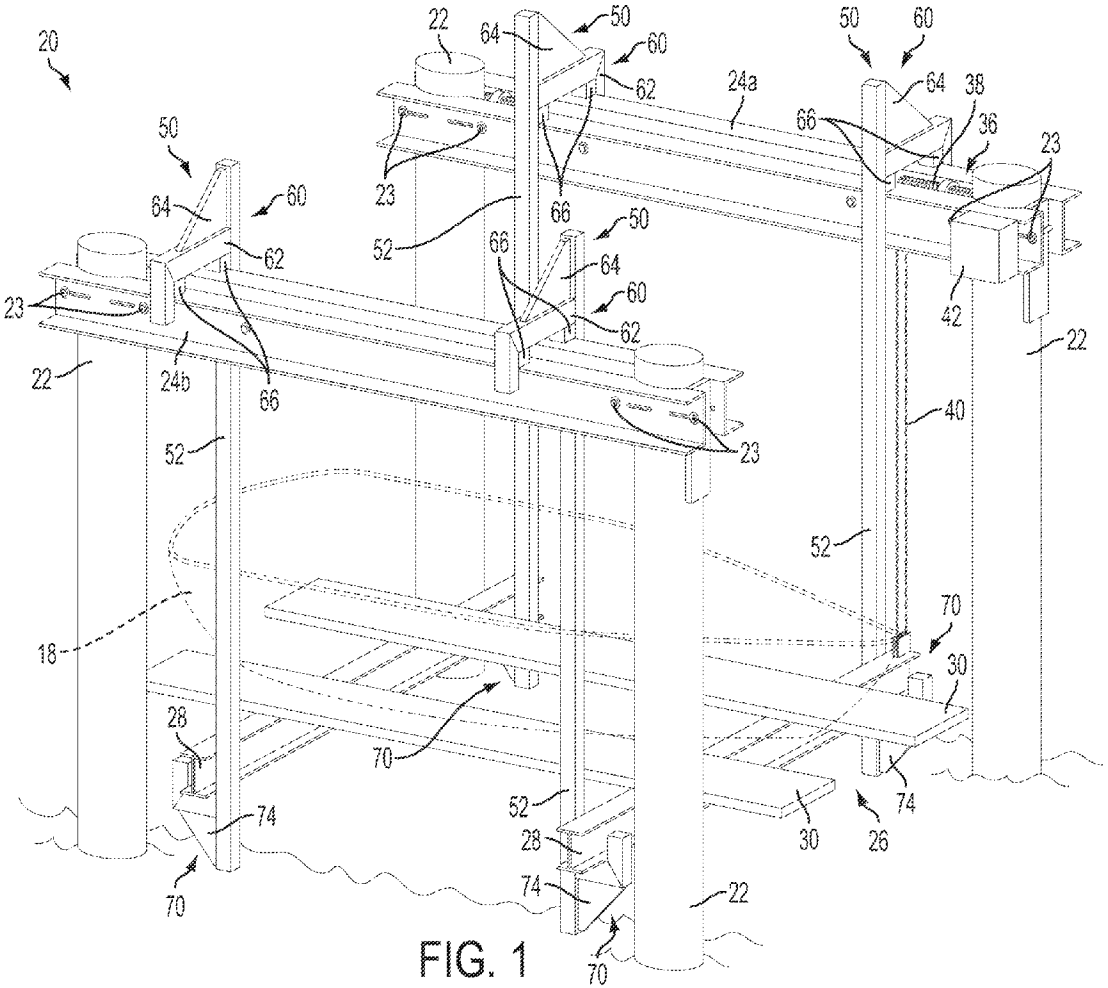
FIG. 1 is a perspective view of security members interfacing with a boat lift system according to at least one embodiment of the present disclosure.

Various embodiments are described and illustrated in this specification to provide an overall understanding of the steps and uses of the disclosed devices and methods. It is understood that the various embodiments described and illustrated in this specification are non-limiting and non-exhaustive. Thus, the invention is not limited by the description of the various non-limiting and non-exhaustive embodiments disclosed in this specification. In appropriate circumstances, the features and characteristics described in connection with various embodiments may be combined with the features and characteristics of other embodiments. Such modifications and variations are intended to be included within the scope of this specification. As such, the claims may be amended to recite any steps, limitations, features, and/or characteristics expressly or inherently described in, or otherwise expressly or inherently supported by, this specification. Further, Applicant(s) reserve the right to amend the claims to affirmatively disclaim steps, limitations, features, and/or characteristics that are present in the prior art regardless of whether such features are explicitly described herein. Therefore, any such amendments comply with the requirements of 35 U.S.C. §112, first paragraph, and 35 U.S.C. §132(a). The various embodiments disclosed and described in this specification can comprise, consist of, or consist essentially of the steps, limitations, features, and/or characteristics as variously described herein.

The grammatical articles "one", "a", "an", and "the", if and as used in this specification, are intended to include "at least one" or "one or more", unless otherwise indicated. Thus, the articles are used in this specification to refer to one or more than one (i.e., to "at least one") of the grammatical objects of the article. By way of example, "a component" means one or more components, and thus, possibly, more than one component is contemplated and may be employed or used in an implementation of the described embodiments. Further, the use of a singular noun includes the plural, and the use of a plural noun includes the singular, unless the context of the usage requires otherwise.

Various embodiments described in this specification are directed to a device for securing a boat in a boat lift system. One non-limiting and non-exhaustive application described and illustrated herein is a plurality of security devices for securing a boat relative to a boat lift system. However, it will be understood that the security devices described herein may be used in connection with any suitable boat lift systems. Furthermore, the security devices described herein can be modified, adjusted and/or scaled to fit various boat lift systems.

An aspect of the present disclosure is directed to a system comprising a boat lift system and security members. In various embodiments, the boat lift system comprises longitudinal supports and a cradle operably moveable upward to a lifted position and downward to a lowered position relative to the longitudinal supports. Further, each security member is structured to hang from a longitudinal support and to operably move along the longitudinal support between an engaged position and a disengaged position. In various embodiments, each security member comprises a bracket structured to hold the cradle in a secured position when the security member is in the engaged position.

Another aspect of the present disclosure is directed to a device for a boat lift system, wherein the boat lift system comprises a plurality of longitudinal supports and a cradle, and wherein the cradle is configured to move between a lifted position and a lowered position relative to the longitudinal supports. In various embodiments, the device comprises a plurality of security members positionable relative to the boat lift system. Further, each security member comprises a hooked portion and a bracket. In various embodiments, the hooked portion is structured to engage one of the longitudinal supports such that the security member hangs therefrom. Further, the hooked portion is structured to move relative to the longitudinal support to move the security member from a supportive position to a non-supportive position relative to the cradle. In various embodiments, the bracket is structured to hold the cradle in a secured position when the security member is in the supportive position.

Another aspect of the present disclosure is directed to a method for selectively preventing movement of a cradle of a boat lift system that is operably moveable between a lifted position and a lowered position relative to longitudinal supports of the boat lift system. In various embodiments, the method comprises hanging a plurality of security members from the longitudinal supports in disengaged positions. The method further comprises positioning the cradle in the lowered position, moving a boat onto the cradle, moving the cradle upward from the lowered position to the lifted position, moving each security member along the longitudinal support from the disengaged position to an engaged position, and moving the cradle downward from the lifted position toward the lowered position. In various embodiments, a bracket of each security member holds the cradle in a locked position intermediate the lifted position and the lowered position.

Figure 2:
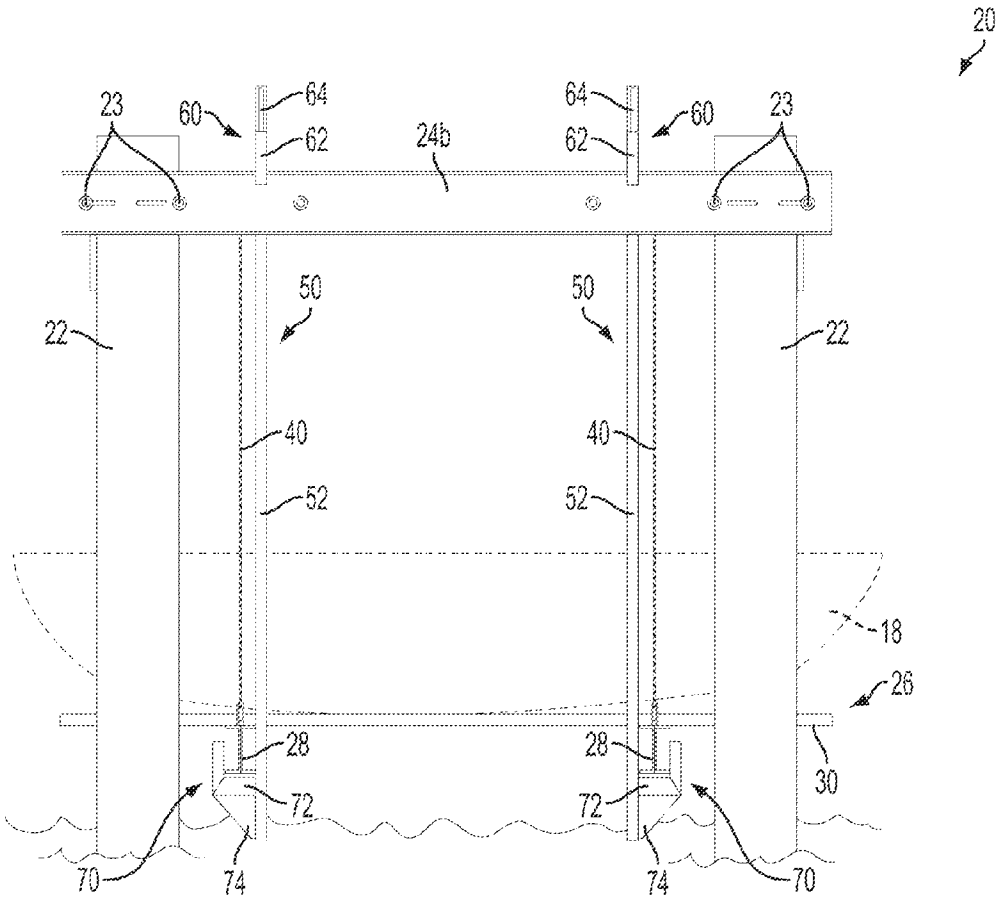
FIG. 2 is an elevational view of security member embodiments and the boat lift system of FIG. 1.
Figure 3:
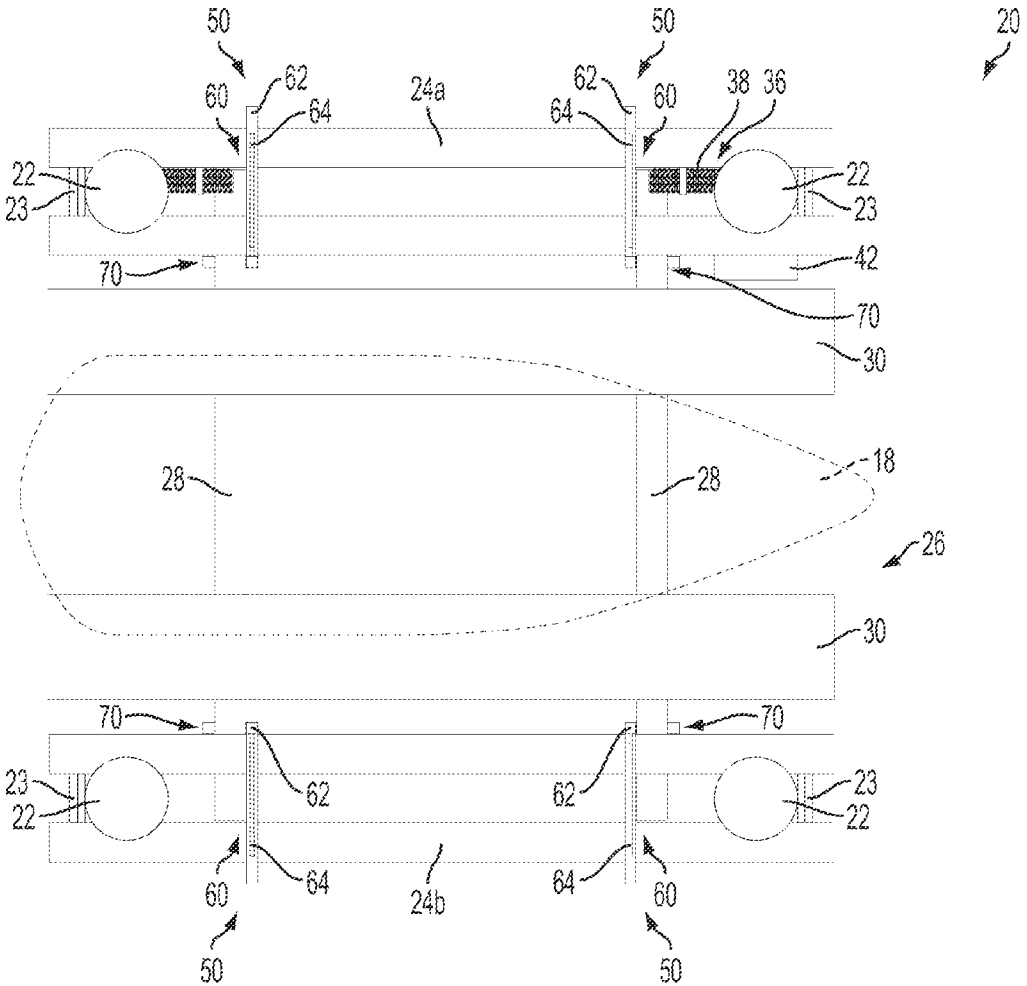
FIG. 3 is a plan view of security member embodiments and the boat lift system of FIG. 1.

Referring primarily to FIGS. 1-3, a security member 50 can prevent unauthorized or unintended removal of a boat 18 from a boat lift system 20. FIGS. 1-3 illustrate one form of a commercially available boat lift system. As the present Detailed Description proceeds, however, a person of ordinary skill in the art will appreciate that the various features and advantages of various security member embodiments disclosed herein may be effectively employed in connection with other commercial boat lift arrangements without departing from the spirit and scope of the present disclosure. For example, the boat lift system 20 can include upright supports 22, longitudinal supports 24*a*, 24*b*, and a cradle 26. In various constructions, the upright supports 22 can be anchored in place by a foundation (not shown) below or above the surface of the water. In at least one arrangement, the upright supports 22 can be otherwise secured at the docking location such as anchored to a dock or the shore, for example. The boat lift system 20 can include four upright supports 22 that define the corners of the boat lift system 20. For example, one upright support 22 can be positioned at each of the four corners of the boat lift system 20. Referring still to FIGS. 1-3, the upright supports 22 can hold and support the longitudinal supports 24*a*, 24*b* of the boat lift system 20. Each longitudinal support 24*a*, 24*b* can traverse between two upright supports 22 on a side of the boat lift system 20. In other words, a first longitudinal support 24*a* can longitudinally extend along a first side of the boat lift system 20 and a second longitudinal support 24*b* can longitudinally extend along a second side of the boat lift system 20. The first and second longitudinal supports 24*a*, 24*b* can be parallel or substantially parallel and the second longitudinal support 24*b* can be laterally positioned relative to the first longitudinal support 24*a*. Further, as shown in FIGS. 1-3, each longitudinal support 24*a*, 24*b* can include two beams, one on each side of the upright support 22. A fastener 23 can extend into and/or through the two beams of each longitudinal support 24*a*, 24*b* and/or through the upright support 22 to secure the two beams of the longitudinal support 24*a*, 24*b* to the upright support 22.

Referring still to FIGS. 1-3, the cradle 26 can be positioned between the parallel-positioned longitudinal supports 24*a*, 24*b*. As described herein, the cradle 26 can move between a lifted position and a lowered position relative to the longitudinal supports 24*a*, 24*b*. Referring still to FIGS. 1-3, the cradle 26 of the boat lift system 20 can include lateral members 28 and cradle members 30. The lateral members 28 can laterally traverse the first and second longitudinal supports 24*a*, 24*b*. The lateral members 28 can be perpendicular or substantially perpendicular to the first and second longitudinal supports 24*a*, 24*b*. Further, the cradle members 30 can be parallel or substantially parallel to the first and second longitudinal supports 24*a*, 24*b*.

Referring still to FIGS. 1-3, the boat lift system 20 can include a lift mechanism 36 configured to move the cradle 26 between the lowered position and the lifted position. The lift mechanism 36 can include a motor 42 and a pulley system having a cable 40 and a pulley drum 38. The cable 40 of the lift mechanism 36 can be a rope, a belt, or a chain, for example. The motor 42 can power the pulley system of the lift mechanism 36 to draw the cable 40 around or from the pulley drum 38. In at least one embodiment, the controls (not shown) for the lift mechanism 36 can be secured to prevent unauthorized use of the lift mechanism and subsequent unauthorized use of the boat held by the cradle. For example, the controls can be secure by requiring a key or access code for operation. Additionally, the controls can be located in a secure location such as a boathouse or garage, for example, and can wirelessly communicate with the lift mechanism 36. In various embodiments, the secure location can be locked to restrict access. When the security members 50 are in an engaged positioned, the security members 50 can operably hold the cradle 26 in a secured position, as described herein. The secured position can be between the lifted and lowered positions.

Referring primarily to FIGS. 4-7, a security member 50 can include a shaft 52 extending between a hooked portion 60 and a bracket 70. In at least one embodiment, the security member 50 can be formed from metal such as aluminum or stainless steel, for example. However, the security members 50 may be formed from other metals or composite materials having sufficient strength to support the loads applied during use. In some embodiments, the various components of the shaft 52, the hooked portion 60 and the bracket 70 can be welded together and/or connected using appropriate fasteners and/or other well-known techniques. The shaft 52 can be tubular and can have a rectangular cross-section, such as a shaft formed from a metal box tube, for example. The shaft 52 and/or other components of the security member 50 can be tubular or hollow to reduce the volume of material and the total weight of the security member 50. When the shaft 52 is tubular, a plate 53 (FIGS. 4 and 5) can cover the end of the shaft 52. In other embodiments, the shaft 52 can be partially, substantially or entirely solid and/or can have a polygonal and/or elliptical cross-section, for example. In other embodiments, the sides of the shaft 52 may remain open. In at least one embodiment, the shaft 52 can be approximately 121 inches by approximately 3 inches by approximately 3 inches, for example. The dimensions of the shaft 52, as well as the other parts of the security member 50 described herein, can be adjusted and/or scaled to fit the security member 50 to various boat lift systems and are not intended to be limiting.

Referring still to FIGS. 4-7, the hooked portion 60 of the security member 50 can include a hook 62, an upper gusset 64, and blocks 66. When the security member 50 is positioned relative to the boat lift system 20 (FIGS. 1-3), as described herein, the hook 62 can extend over and partially around the longitudinal support 24*a*, 24*b* to engage the boat lift system 20. In at least one embodiment, the hook 62 can be formed from two sections of metal box tube that have been cut, mitered, and welded together at a right angle. In at least one embodiment, the first section can be approximately 14 inches by approximately 3 inches by approximately 3 inches, for example, and the second section can be approximately 9 inches by approximately 3 inches by approximately 3 inches, for example. When the hook 62 is tubular, a plate 63 (FIG. 4) can cover the end of the hook 62.

Figure 4:
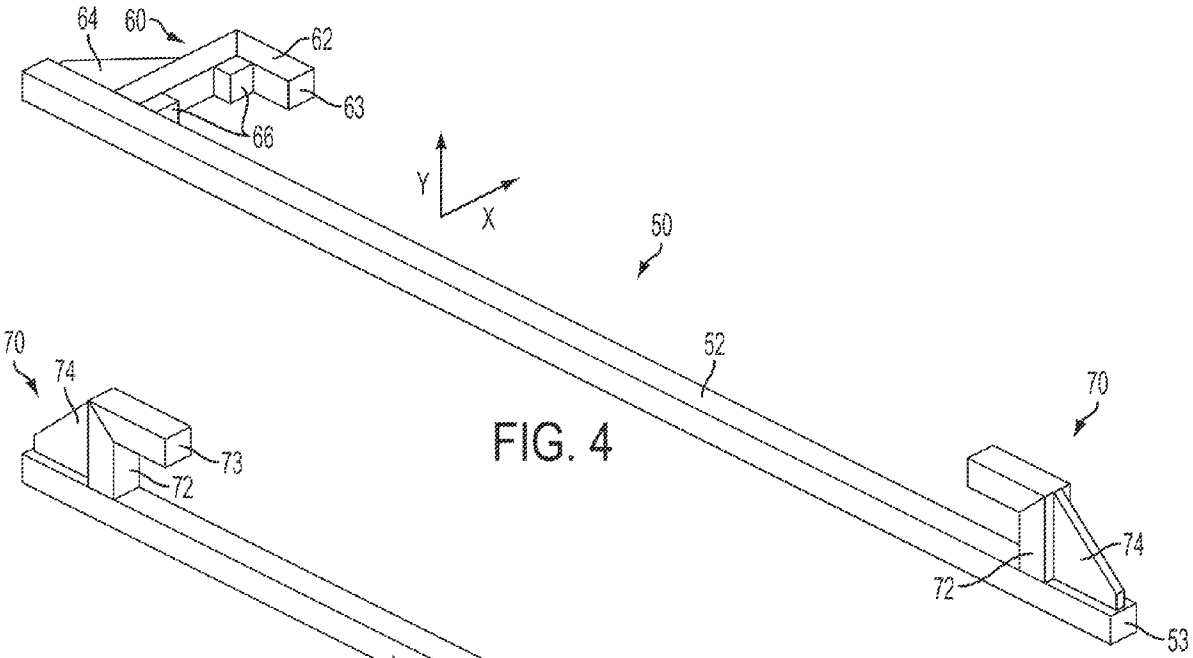
FIG. 4 is a perspective view of a security member embodiment of FIG. 1.
Figure 5:
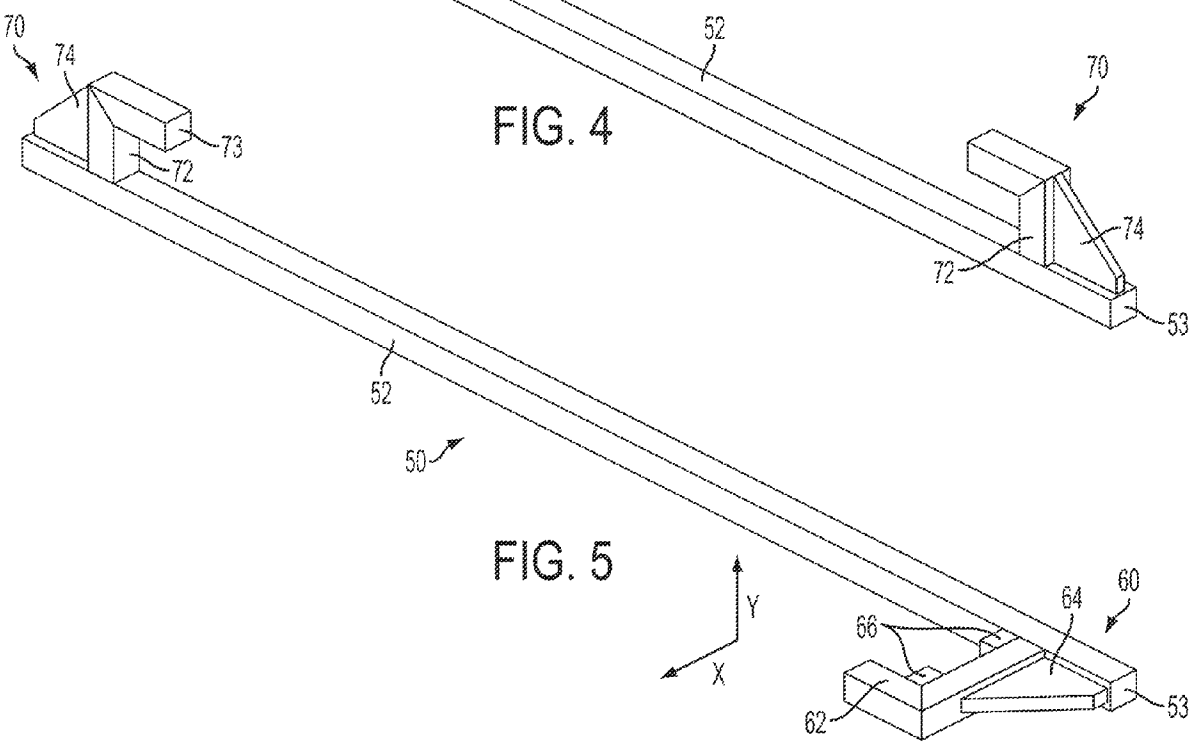
FIG. 5 is another perspective view of a security member embodiment of FIG. 1.
Figure 6:
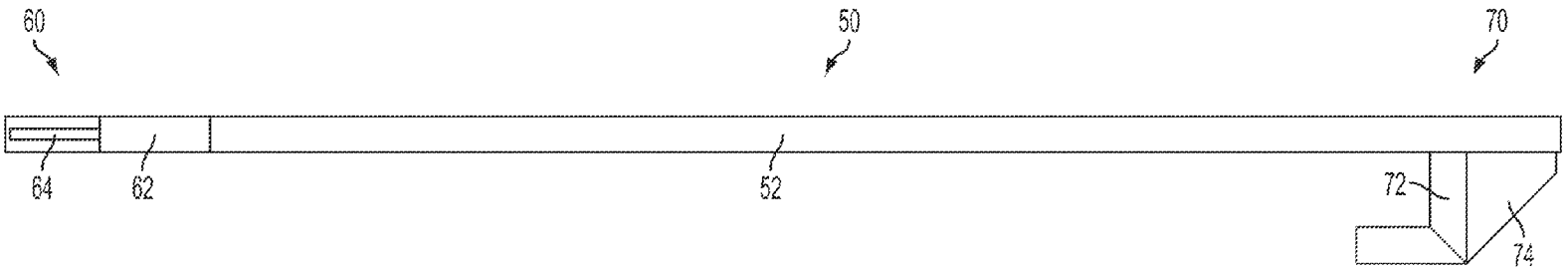
FIG. 6 is an elevational view of a security member embodiment of FIG. 1.
Figure 7:
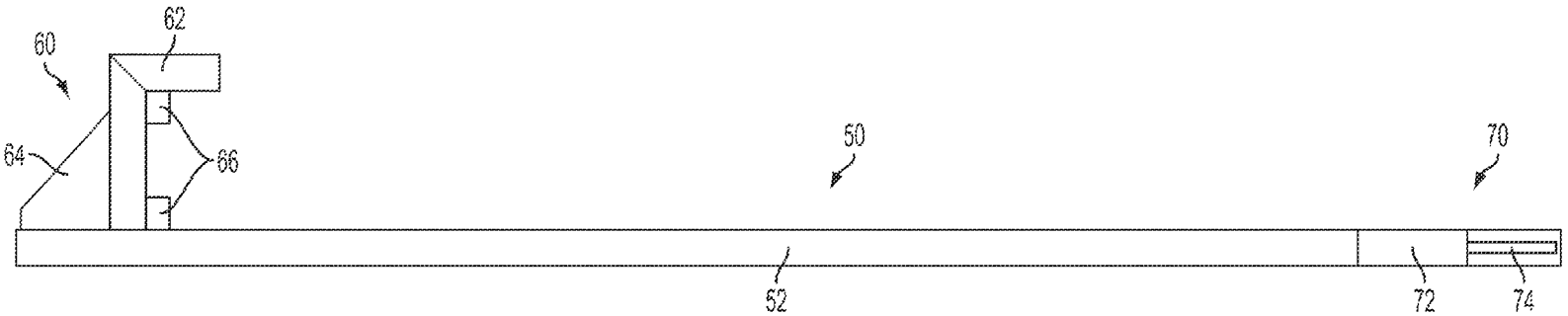
FIG. 7 is another elevational view of a security member embodiment of FIG. 1.

The upper gusset 64 of the hooked portion 60 can extend between the shaft 52 and the hook 62. The upper gusset 64 can support the hook 62 relative to the shaft 52 to increase the strength and durability of the security member 50. In at least one embodiment, the upper gusset 64 can be a flat or substantially flat plate that is approximately 0.5 inches thick, for example. In at least one embodiment, the upper gusset 64 can be approximately 9 inches by approximately 0.5 inches by approximately 8 inches, for example, and can include an angled side. The block 66 of the security member 50 can be positioned within the hook 62 of the hooked portion 60. When the block 66 is tubular, a plate can cover the end of the block 66. When the security member 50 is positioned relative to the boat lift system 20, as described herein, the block 66 can lift the hook 62 out of contact with any top-mounted equipment such as the lift mechanism 36 (FIGS. 1 and 3), for example. Referring primarily to FIGS. 4, 5, and 7, the security member 50 can have two blocks 66 in the hook 62 such that a pulley drum 38 and/or cable 40 can protrude between the two blocks 66. One block 66 can be welded to the shaft 52 and a first section of the hook 62 and another block 66 can be welded to the first and second sections of the hook 62. In at least one embodiment, the blocks 66 can be formed from a metal box tube and can be approximately 2 inches by approximately 3 inches by approximately 3 inches, for example. The exemplary dimensions of the hooked portion 60 of the security member 50 can be adjusted and/or scaled to fit the security member 50 to various boat lift systems and are not intended to be limiting.

As described herein, the security member 50 can be positioned relative to the boat lift system 20 such that the hooked portion 60 engages a longitudinal support 24*a*, 24*b* and the security member 50 hangs from the longitudinal support 24*a*, 24*b* (FIGS. 1-3). Furthermore, the hooked portion 60 can be structured to move along or relative to the longitudinal support 24*a*, 24*b* to move the security member 50 from an engaged, or supportive, position to a disengaged, or non-supportive, position relative to the cradle 26. In at least one embodiment, the hooked portion 60 of each security member 50 can slide along a top surface of the longitudinal support 24*a*, 24*b*. The hooked portion 70 can include a polymeric coating or pad (not shown) to reduce friction and ease movement of the hooked portion 70 along the longitudinal support 24*a*, 24*b*. The coating or pad can comprise polytetrafluoroethylene (PTFE) (Teflon®), for example. In various embodiments, a bottom surface of the block(s) 66 of the hooked portion 70, which can come into contact with the longitudinal support 24*a*, 24*b*, can include a PTFE coating.

Referring still to FIGS. 4-7, the bracket 70 of the security member 50 can include a shelf 72 and a lower gusset 74. When the security member 50 is in the supportive position, the bracket 70 can be structured to hold the cradle 26 (FIGS. 1-3) in a secured position, as described herein. The cradle 26 can rest on the shelf 72 of the bracket 70 when the cradle 26 is held in the secured position. In at least one embodiment, the shelf 72 can be formed from two sections of metal box tube that have been cut, mitered, and welded together at a right angle. In at least one embodiment, the first section can be approximately 10 inches by approximately 3 inches by approximately 3 inches, for example, and the second section can be approximately 9 inches by approximately 3 inches by approximately 3 inches, for example. When the bracket 70 is tubular, a plate 73 (FIG. 5) can cover the end of the bracket 70. Furthermore, the lower gusset 74 can extend between the shaft 52 and the shelf 72 to help secure the shelf 72 to the shaft 52. The lower gusset 74 can support the shelf 72 relative to the shaft 52 to increase the strength and durability of the security member 50. In at least one embodiment, the lower gusset 74 can be a flat or substantially flat plate that is approximately 0.5 inches thick, for example. In at least one embodiment, the lower gusset 72 can be approximately 10 inches by approximately 0.5 inches by approximately 8 inches, for example. The exemplary dimensions of the bracket 70 of the security member 50 can be adjusted and/or scaled to fit the security member 50 to various boat lift systems and are not intended to be limiting.

Referring primarily to FIGS. 4 and 5, the hooked portion 60 of the security member 50 can extend from the security member 50 in a first direction X. In other words, the hook 62 can extend away from the shaft 52 in the first direction X. Furthermore, the bracket 70 of each security member 50 can extend from the security member 50 in a second direction Y. In other words, the shelf 72 of the bracket 70 can extend from the shaft 52 in the second direction Y. Referring still to FIGS. 4 and 5, the second direction Y can be rotationally oriented relative to the first direction X. For example, the second direction Y can be rotationally oriented approximately 90 degrees relative to the first direction X such that the axis defined by the hooked portion 60 is at a right angle or substantially a right angle to the axis defined by the bracket 70.

Figure 8:
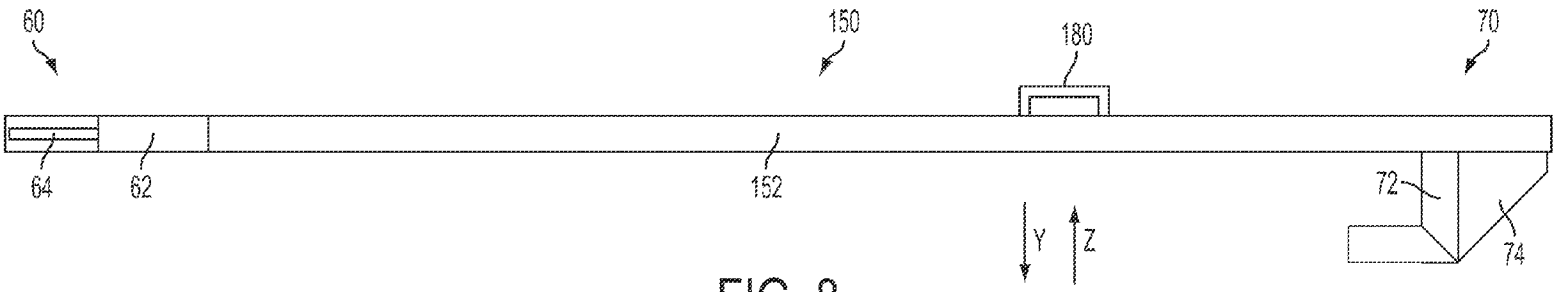
FIG. 8 is an elevational view of a security member having a handle according to at least one other embodiment of the present disclosure.
Figure 9:
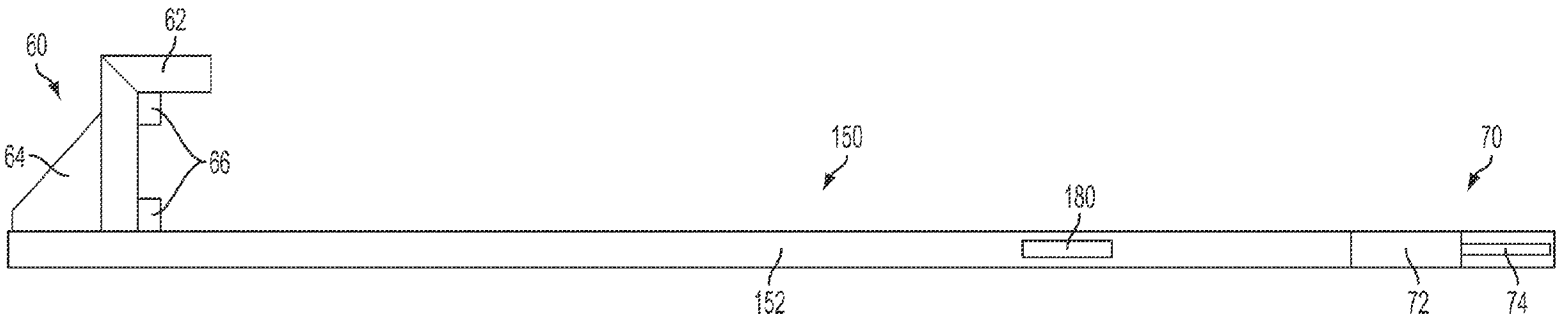
FIG. 9 is an elevational view of the security member embodiment of FIG. 8.

Referring primarily to FIGS. 8 and 9, a security member 150 having a shaft 152 can be substantially similar to the security member 50 having the shaft 52, which is described herein. Additionally, the security member 150 can have a handle 180 on the shaft 152 between the hooked portion 60 and the bracket 70. The handle 180 can extend from the shaft 152 in a third direction Z that is opposite to or substantially opposite to the second direction Y (FIG. 8). In other words, the third direction Z can be rotationally oriented approximately 90 degrees from the first direction X (FIGS. 4 and 5) and approximately 180 degrees from the second direction Y. The handle 180 can provide a surface for a user to grasp in order to facilitate movement of the security member 150 relative to longitudinal support 24*a*, 24*b* (FIGS. 1-3).

Figure 10:
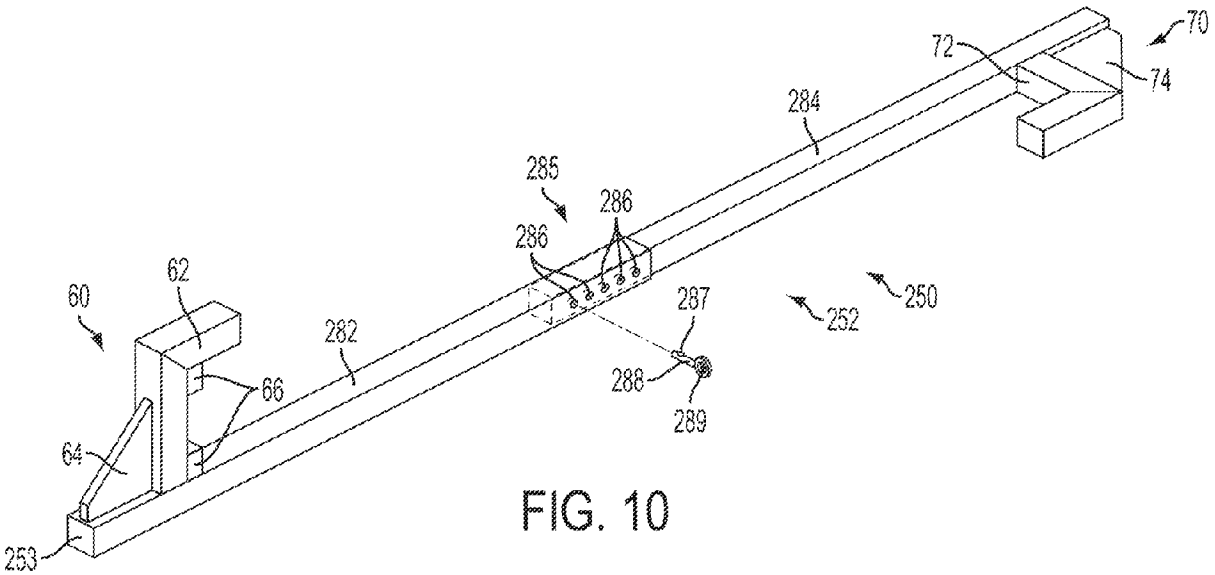
FIG. 10 is a perspective view of a telescoping security member according to at least one other embodiment of the present disclosure.
Figure 11:
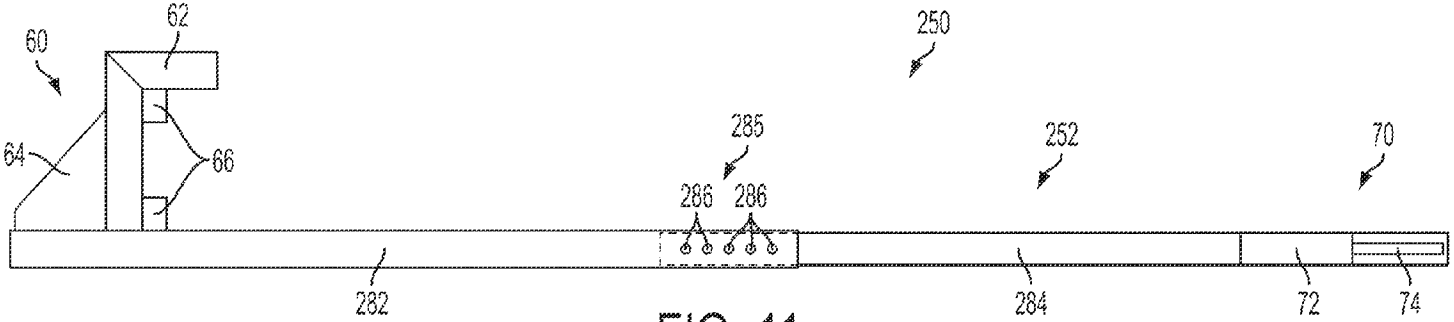
FIG. 11 is an elevational view of the telescoping security member embodiment of FIG. 10.

Referring again to FIGS. 4-7, the shaft 52 of the security member 50 can have a fixed, non-variable length. Referring now to FIGS. 10 and 11, a shaft 252 of a security member 250, which is substantially similar to the security member 50, can have a non-fixed, variable length. The shaft 252 can include two components—a first component 282 and a second component 284. The first component 282 can include the hooked portion 60 and the second component 284 can include the bracket 70. Furthermore, the second component 284 can be structured to telescope or move axially relative to the first component 282. In other words, at least a portion of the first component 282 can be hollow and can receive at least a portion of the second component 284 therein such that the first and second components 282, 284 operably overlap. A plate 253 can cover the end of the hollow first component (FIG. 10). The second component 284 can slide inward and outward relative to the first component 282.

Referring still to FIGS. 10 and 11, the security member 250 can further include a locking assembly 285 structured to secure the second component 284 relative to the first component 282. The locking assembly 285 can include an opening 286 in the first component 282 and an opening 286 in the second component 284. When the openings 286 of the first and second components 282, 284 are aligned, a pin 288 of the locking assembly 285 can be positioned through the openings 286 to secure the first component 282 relative to the second component 284. In at least one embodiment, the pin 288 can include a lock or detent 287 along the shaft of the pin 288 to secure the pin 288 in position in the openings 286. The pin 288 can also include a pulling eye 289 to facilitate removal of the pin 288 from the openings 286. Referring still to FIGS. 10 and 11, the first and/or the second components 282, 284 can include a plurality of openings 288 arranged in a row. By increasing or decreasing the overlapping sections of the first and second components 282, 284, the length of the security member 150 can be adjusted. In at least one embodiment, a first component of a variable-length security member shaft can be positioned relative to a second component of the variable-length security member shaft by other well-known techniques such as a detent assembly and/or a threaded connection, for example.

Referring again to FIGS. 1-3, a plurality of security members 50 can be positioned relative to the boat lift system 20 to prevent unauthorized or otherwise unintended deployment of the cradle 26. For example, the hooked portion 60 of each security member 50 can engage a longitudinal support 24*a*, 24*b* such that each security member 50 hangs from a longitudinal support 24*a*, 24*b*. Furthermore, in at least one embodiment, a single security member 50 can hang from the first longitudinal support 24*a* and a single security member 50 can hang from the second longitudinal support 24*b* such that only one security member 50 is positioned on each side of the cradle 26. Referring still to FIGS. 1-3, two security members 50 can hang from the first longitudinal support 24*a* and two security members 50 can hang from the second longitudinal support 24*b*. In such an arrangement, two security members 50 can hang from each longitudinal support 24*a*, 24*b* between adjacent upright supports 24*a*, 24*b*. In other words, two security members 50 can be positioned on each side of the cradle 26 and four total security members 50 can be positioned relative to the boat lift system 20.

As described herein, the security members 50 can move between the engaged or supportive position and the disengaged or non-supportive position. In the engaged position, the bracket 70 can be aligned with a lateral member 28 of the cradle 26 and can be structured to receive a portion of the lateral member 28 on the shelf 72 thereof. The bracket 70 of the security member 50 on the first longitudinal support 24*a* can receive a first end of a corresponding lateral member 28 and the bracket 70 of the security member 50 on the second longitudinal support 24*b* can receive a second end of that same lateral member 28. Referring primarily to FIGS. 1 and 2, the lateral member 28 can rest on the shelf 72 of each bracket 70 when the security member 50 is engaged with the cradle 26 in the engaged or supportive position. In the disengaged or non-supportive position, the bracket 70 can be misaligned with the lateral members 28 of the cradle 26 to permit the cradle 26 to be raised or lowered. In other words, though the cradle 26 can be lowered to and/or past the secured position, the bracket 70 will not engage or catch a lateral member 28 of the cradle 26. In the disengaged position, the cradle 26 can move upward and downward past the bracket 70 without engaging it, and thus the cradle 26 can be lowered to the lowered position, for example, to place the boat 18 in the water.

Referring still to FIGS. 1-3, to dock the boat 18 in the boat lift system 20, the cradle 26 can be positioned in the lowered position. The lift mechanism 36 can be used to draw the pulley cable 40 from the pulley drum 38 to lower the cradle 26. Once the cradle 26 is positioned in the lowered position, the boat 18 can be moved onto the cradle 26. The cradle members 30 of the cradle 26 can securely hold the boat 18. In at least one embodiment, the cradle members 30 can surround a portion of the boat 18 such that the arrangement of the cradle members 30 can match or substantially match the form of a bottom portion of the boat 18.

Once the boat 18 is securely held in the cradle 26, referring still to FIGS. 1-3, the lift mechanism 36 can be employed to affect the position of the cradle 26 and the boat 18 thereon. The lift mechanism 36 can be used to wrap the pulley cable 40 around the pulley drum 38 to lift the cradle 26 from the lowered position to the lifted position. Once the cradle 26 is in the lifted position, the security members 50 can be moved along the longitudinal supports 24*a*, 24*b* from the disengaged position to the engaged position. The security members 50 can slide along the longitudinal supports 24*a*, 24*b*, for example, and a handle 180 (FIGS. 8 and 9) can facilitate movement of the security members 50 between the disengaged and the engaged positions. Upon positioning the security members 50 in the engaged position, the cradle 26 can be moved downward from the lifted position towards the lowered position. The lift mechanism 36 can be used to draw the pulley cable 40 from the pulley drum 38 to lower the cradle 26. Downward movement of the cradle 26 can by limited by the brackets 70 of the security members 50 in the engaged position. The brackets 70 can receive the lateral members 28 of the cradle 26 to prevent the cradle 26 from lowering beyond the secured position. In other words, the cradle 26 can be held in the secured position, though the lift mechanism 36 can continue to draw the pulley cable 40 from the pulley drum 38 and attempt to further lower the cradle 26. Slack may gather in the pulley cable 40 as the lift mechanism 36 attempts to continue lowering the cradle 26 after the cradle 26 has reached the secured position.

Referring still to FIGS. 1-3, when the security members 50 hold the cradle 26 in the secured position, the boat 18 can exert a gravitational force on the cradle 26 and a corresponding force among the hooked portions 60 of the security members 50. The gravitational force exerted by the boat 18 can operably restrain movement of the security members 50 from the engaged position to the disengaged position. In other words, the deadweight of the boat 18 can prevent disengagement of the security members 50, and thus, lock the secured boat 18 in the boat lift system 20. In at least one embodiment, a boat owner can turn off power to the lift mechanism 36 and/or prevent access to the lift mechanism control. Accordingly, the cradle 26 can remain in the secured position even if the pulley cable 40 is severed or broken.

To release the boat 18, referring still to FIGS. 1-3, the lift mechanism 36 can be used to lift the cradle 26 upward from the secured position to the lifted position. The cradle 26 can be moved upward at least until it disengages the bracket 70 of the security member 50. Once the cradle 26 disengages the bracket 70, the security members 50 can be moved along the longitudinal support 24*a*, 24*b* from the engaged position to the disengaged position. The security members 50 can slide along longitudinal supports 24*a*, 24*b*, for example, and a handle 180 (FIGS. 8 and 9) may be used to facilitate movement of the security members 50 along the longitudinal supports 24*a*, 24*b* between the engaged and disengaged positions. Once the security members 50 are in the disengaged position, the cradle 26 can be moved downward from the lifted position to the lowered position, for example, to lower the boat 18 into the water. The boat locking and unlocking process described herein can be repeated as necessary to relock the boat after use and to re-unlock the boat for subsequent use.

Figure 12:
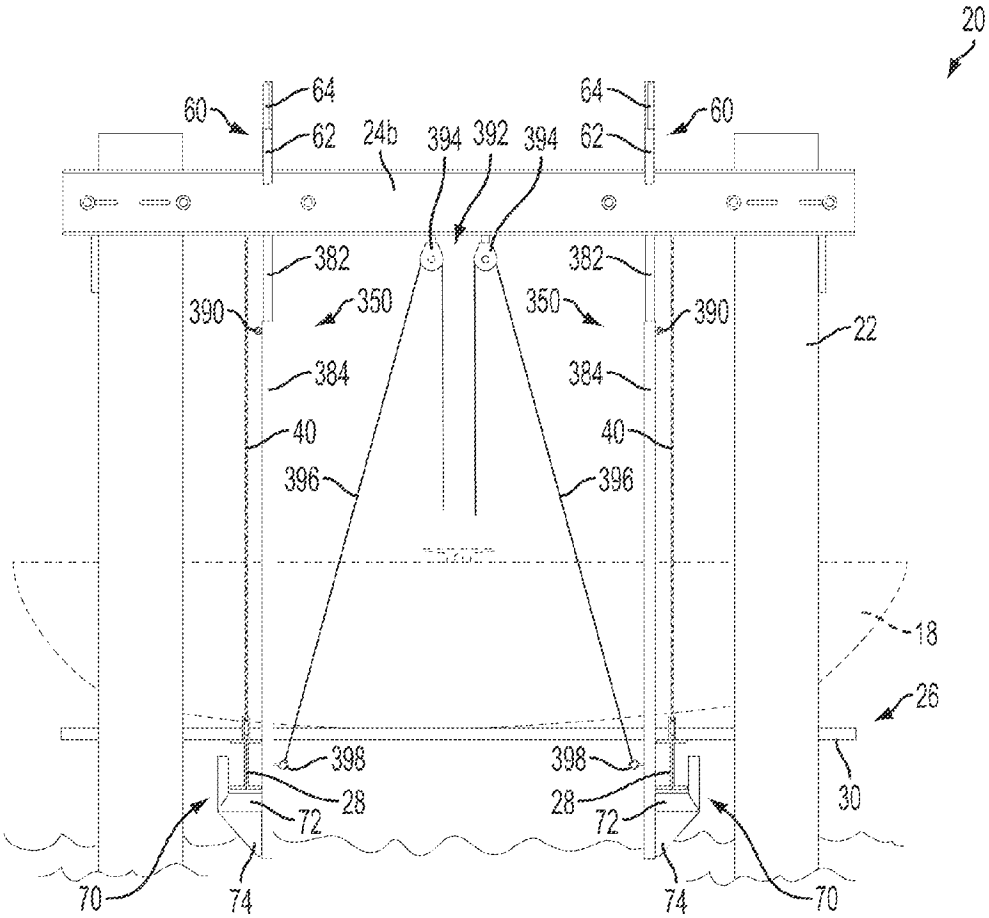
FIG. 12 is an elevational view of hinged security member embodiments interfacing with the boat lift system of FIG. 1 according to at least one other embodiment of the present disclosure.

Referring now to FIG. 12, a security member 350 can include a first component 382 and a second component 384, similar to the security member 250 described in herein. The first component 382 can include the hooked portion 60 and the second component 384 can include the bracket 70. Similar to other embodiments described herein, the hooked portion 60 can be structured to engage the longitudinal member 24*a*, 24*b* and the bracket 70 can operably support the cradle 26. A hinge 390 can hingedly connect the first component 382 and the second component 384 such that the security member 350 is structured to pivot or rotate at the hinge 390. The security member 350 can pivot or rotate at the hinge between an engaged position and a disengaged position. When the security member 350 is in the engaged position, the bracket 70 can hold the cradle 26 in a secured position. Further, when the security member 350 is in the disengaged position, the cradle 26 can be moved to the lowered position. The second component 384 of the security member 350 can pivot upward to the disengaged position such that the bracket 70 moves out of alignment with the lateral member 28 of the cradle 26. Further, the second component 384 can pivot downward to the engaged position such that the bracket 70 moves into alignment with the lateral member 28 of the cradle 26.

The security member 350 can include a pulley system 392 to facilitate rotation of the security member 350 at the hinge 390 to move the security member 350 between the engaged position and the disengaged position. The pulley system 392 can include a sheave 394 and a cable 396. The cable 396 can run through the sheave 394 and be secured to an eye bolt 398 in the second component 384 of the security member 350. A force exerted on one end of the cable 396 can pull the cable 396 through the sheave 394 to pivot the second component 384 upward toward the first component 382 and to a disengaged position. In at least one embodiment, the pulley system 392 can include a cleat (not shown), such as a jamb cleat, for example, that holds the cable 396 in place relative to the sheave 394. In such embodiments, the security member 350 can be held in the disengaged position when not in use. Alternatively, the second component 384 can fall back into the engaged position upon removal of the force to the end of the cable 396. Additionally, a brace rod (not shown) can be positioned between the first components 382 of adjacent security members 350 to maintain the distance between the first components 382 when the second components 384 are pulled upward to the disengaged position.

In various embodiments, a system comprises a boat lift system and security members. The boat lift system comprises longitudinal supports and a cradle operably moveable upward to a lifted position and downward to a lowered position relative to the longitudinal supports. Each security member is structured to hang from a longitudinal support and to operably move along the longitudinal support between an engaged position and a disengaged position. Each security member comprises a bracket structured to hold the cradle in a secured position when the security member is in the engaged position.

In some of these embodiments, each security member comprises a hooked portion structured to engage one of the longitudinal supports to enable the security member to hang therefrom. In some embodiments, each hooked portion extends from the security member in a first direction, wherein each bracket extends from the security member in a second direction, and wherein the second direction is rotationally oriented relative to the first direction. In some of these embodiments, the second direction is rotationally oriented approximately 90 degrees relative to the first direction. In some embodiments, the boat lift system comprises a lift mechanism configured to move the cradle between the lowered position and the lifted position. In some embodiments, the longitudinal supports comprise: a first longitudinal support and a second longitudinal support laterally positioned relative to the first longitudinal support, wherein the cradle is positioned between the first and second longitudinal supports, and wherein at least one security member is constructed to hang from the first longitudinal support and at least one security member is constructed to hang from the second longitudinal support. In some of these embodiments, two security members hang from the first longitudinal support and two security members hang from the second longitudinal support. In some of these embodiments, the cradle comprises lateral members between the first and second longitudinal supports, wherein the bracket of each security member is configured to receive a portion of one of the lateral members.

In some embodiments, at least one security member comprises a variable length. In some of these embodiments, at least one security member comprises a first component, a second component comprising the bracket, wherein the second component is structured to move axially relative to a portion of the first component, and a locking assembly structured to secure the second component relative to the first component. In some embodiments, a gravitational force exerted by a boat positioned on the cradle operably restrains movement of each security member from the engaged position.

In some embodiments, a method for selectively preventing movement of a cradle of a boat lift system comprises positioning the security members relative to the boat lift system such that each security member hangs from a longitudinal support of the boat lift system, positioning the cradle in the lowered position, moving a boat onto the cradle, moving the cradle upward from the lowered position to the lifted position, moving each security member along the longitudinal support from the disengaged position to the engaged position, and moving the cradle downward from the lifted position to the secured position, wherein the bracket of each security member holds the cradle in the secured position.

In various embodiments, a device for a boat lift system comprises a plurality of security members positionable relative to the boat lift system The boat lift system comprises a plurality of longitudinal supports and a cradle, and wherein the cradle is configured to move between a lifted position and a lowered position relative to the longitudinal supports. Each security member comprises a hooked portion and a bracket. The hooked portion is structured to engage one of the longitudinal supports such that the security member hangs therefrom. The hooked portion is structured to move along the longitudinal support to move the security member from a supportive position to a non-supportive position relative to the cradle. The bracket is structured to hold the cradle in a secured position between the lifted and lowered positions when the security member is in the supportive position.

In some of these embodiments, the hooked portion of each security member extends from the security member in a first direction, wherein the bracket of each security member extends from the security member in a second direction, and wherein the second direction is rotationally oriented approximately 90 degrees relative to the first direction. In some embodiments, at least one security member comprises a handle between the hooked portion and the bracket. In some of these embodiments, the plurality of security members consists of four security members. In some embodiments, each security member comprises a hinge, and wherein each security member is structured to rotate at the hinge. In some of these embodiments, the device comprises a pulley system configured to rotate each security member at its respective hinge to selectively facilitate movement of each security member between the supportive position and the non-supportive position.

In various embodiments, a method for selectively preventing movement of a cradle of a boat lift system that is operably moveable between a lifted position and a lowered position relative to longitudinal supports of the boat lift system comprises hanging a plurality of security members from the longitudinal supports in disengaged positions. Each security member comprises a bracket. The boat lift system comprises longitudinal supports and a cradle operably moveable between a lifted position and a lowered position relative to the longitudinal supports. Each security member hangs from a longitudinal support of the boat lift system. The method further comprises positioning the cradle in the lowered position, moving a boat onto the cradle, moving the cradle upward from the lowered position to the lifted position, moving each security member along the longitudinal support from the disengaged position to an engaged position, and moving the cradle downward from the lifted position toward the lowered position. A bracket of each security member holds the cradle in a locked position intermediate the lifted position and the lowered position. In some of these embodiments, the method further comprises lifting the cradle upward from the locked position to the lifted position, moving each security member along the longitudinal support from the engaged position to the disengaged position, and lowering the cradle downward from the lifted position to the lowered position.

This specification has been written with reference to various non-limiting and non-exhaustive embodiments. However, it will be recognized by persons having ordinary skill in the art that various substitutions, modifications, or combinations of any of the disclosed embodiments (or portions thereof) may be made within the scope of this specification. Thus, it is contemplated and understood that this specification supports additional embodiments not expressly set forth herein. Such embodiments may be obtained, for example, by combining, modifying, or reorganizing any of the disclosed steps, components, elements, features, aspects, characteristics, limitations, and the like, of the various non-limiting embodiments described in this specification. In this manner, Applicants reserve the right to amend the claims during prosecution to add features as variously described in this specification, and such amendments comply with the requirements of 35 U.S.C. §112, first paragraph, and 35 U.S.C. §132(a).

The invention claimed is:

1. A method for selectively preventing movement of a cradle of a boat lift system, wherein the boat lift system comprises longitudinal supports and a cradle operably moveable upward to a lifted position and downward to a lowered position relative to the longitudinal supports, wherein the cradle comprises a lateral member that is oriented transverse to the longitudinal supports and that extends between adjacent longitudinal supports, and wherein the method comprises:

positioning security members relative to the boat lift system such that each security member hangs from a longitudinal support of the boat lift system, wherein each security member is structured to directly hang from one of the longitudinal supports and to operably move along the longitudinal support in a direction transverse to the orientation of the lateral member between an engaged position and a disengaged position while hanging from the longitudinal support, wherein each security member comprises a bracket structured to engage the lateral member to hold the cradle in a secured position when the security member is in the engaged position, and wherein each bracket is disengaged from the cradle when the corresponding security member is in the disengaged position;

positioning the cradle in the lowered position;

moving a boat onto the cradle;

moving the cradle upward from the lowered position to the lifted position;

moving each security member along the longitudinal support from the disengaged position to the engaged position; and moving the cradle downward from the lifted position to the secured position, wherein the bracket of each security member holds the cradle in the secured position.

2. A method for selectively preventing movement of a cradle of a boat lift system that is operably moveable between a lifted position and a lowered position relative to longitudinal supports of the boat lift system, wherein the cradle comprises a lateral member that traverses between adjacent longitudinal supports, the method comprising:

hanging a plurality of security members directly from the longitudinal supports in disengaged positions, wherein the security members are disengaged from the lateral member of the cradle when in the disengaged positions;

positioning the cradle in the lowered position;

moving a boat onto the cradle;

moving the cradle upward from the lowered position to the lifted position;

moving each security member along the longitudinal support in a direction transverse to the lateral member from the disengaged position to an engaged position while the security member is hanging from the longitudinal support; and moving the cradle downward from the lifted position toward the lowered position, wherein a bracket of each security member holds the lateral member of the cradle in a locked position intermediate the lifted position and the lowered position.

3. The method of claim 2, further comprising:

lifting the cradle upward from the locked position to the lifted position;

moving each security member along the longitudinal support from the engaged position to the disengaged position; and lowering the cradle downward from the lifted position to the lowered position.

4. The method of claim 2, wherein each security member comprises a hooked portion structured to engage one of the longitudinal supports to enable the security member to hang therefrom.

5. The method of claim 4, wherein each hooked portion extends from the security member in a first direction, wherein each bracket extends from the security member in a second direction, and wherein the second direction is rotationally oriented relative to the first direction.

6. The method of claim 5, wherein the second direction is rotationally oriented approximately 90 degrees relative to the first direction.

7. The method of claim 2, further comprising moving the cradle between the lowered position and the lifted position with a lift mechanism.

8. The method of claim 2, wherein the longitudinal supports comprise:

a first longitudinal support; and a second longitudinal support laterally positioned relative to the first longitudinal support, wherein the cradle is positioned between the first and second longitudinal supports, and wherein at least one security member is constructed to hang from the first longitudinal support and at least one other security member is constructed to hang from the second longitudinal support.

9. The method of claim 8, wherein two security members hang from the first longitudinal support and two security members hang from the second longitudinal support.

10. The method of claim 9, wherein the cradle comprises a plurality of lateral members between the first and second longitudinal supports, wherein the bracket of each security member is configured to receive a portion of one of the lateral members.

11. The method of claim 2, further comprising adjusting the length of at least one security member.

12. The method of claim 11, wherein at least one security member comprises:

a first component;

a second component comprising the bracket, wherein the second component is structured to move axially relative to of the first component; and a locking assembly structured to secure the second component relative to the first component.

13. The method of claim 2, wherein a gravitational force exerted by a boat positioned on the cradle operably restrains movement of each security member from the engaged position.

* * * * *